US005428981A

United States Patent [19]

Grothe et al.

[11] Patent Number: 5,428,981

[45] Date of Patent: Jul. 4, 1995

[54] APPARATUS AND METHOD FOR FORMING OF A WIDE SIDE WALL FOR A CHILL MOLD INTENDED FOR A THIN SLAB CASTING INSTALLATION

[75] Inventors: Horst Grothe, Kaarst; Erk Boysen, Ratingen; Hans Streubel, Erkrath, all of Germany

[73] Assignee: SMS Schloemann-Siemag Aktiengesellschaft, Düsseldorf, Germany

[21] Appl. No.: 45,357

[22] Filed: Apr. 2, 1993

[30] Foreign Application Priority Data

Apr. 4, 1992 [DE] Germany ..... 42 11 405.5
Oct. 6, 1992 [DE] Germany ..... 42 33 522.1

[51] Int. Cl.[6] ..... B21D 5/01
[52] U.S. Cl. ..... 72/297; 72/379.2
[58] Field of Search ..... 72/297, 312, 313, 323, 72/350, 379.2, 395, 411, 414, 379.6

[56] References Cited

U.S. PATENT DOCUMENTS 2,047,906 7/1936 Murphy ..... 72/313
2,330,572 9/1943 Frey et al. ..... 72/414
4,617,818 10/1986 Fukuyori ..... 72/379.2

FOREIGN PATENT DOCUMENTS 226321 10/1991 Japan ..... 72/313
109340 3/1925 Switzerland ..... 72/379.2

*Primary Examiner*—Lowell A. Larson
*Attorney, Agent, or Firm*—Anderson Kill Olick & Oshinsky

[57] ABSTRACT

A method of forming a wide side wall of a chill mold for a thin slab casting installation and which has a bulged widened region proceeding from the upper edge of the wall and terminating toward the sides and toward the bottom of the wall, includes making the wall of copper with a thickness of 5–50 mm, and forming the bulged widened region under tension or a combination of tension and compression conditions.

The apparatus for performing the method includes a bottom plate die with an appropriate contoured face, and a power-operated upper die the end face of which is shaped to match desired bulge of the widened region of the wall and cooperates with the contoured face of the bottom die plate to form the widened region.

4 Claims, 3 Drawing Sheets

FIG.1
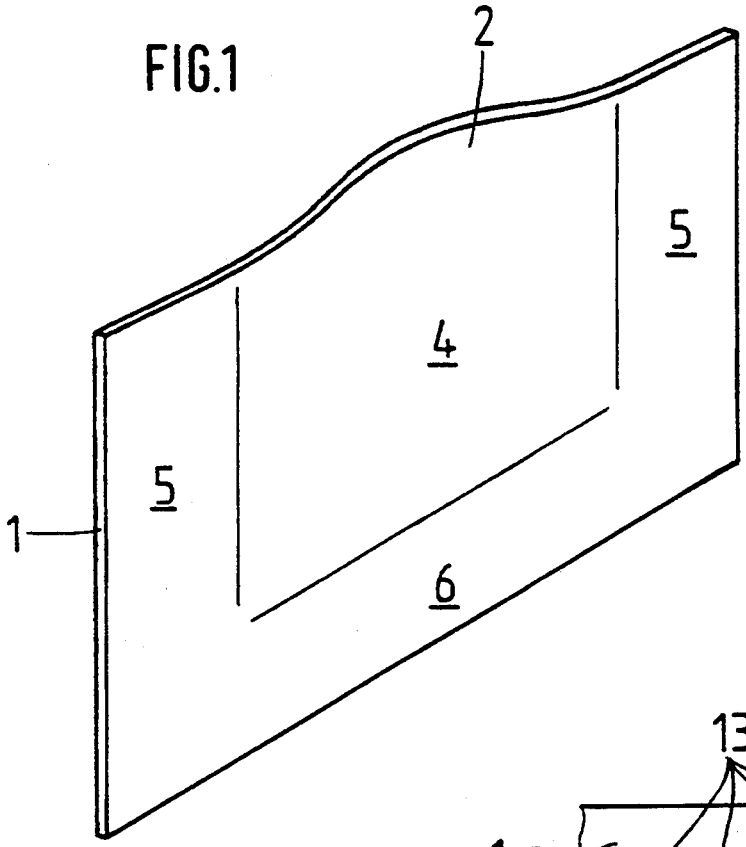
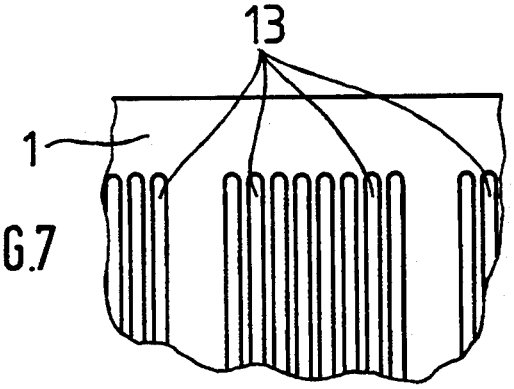
FIG.7
FIG.2
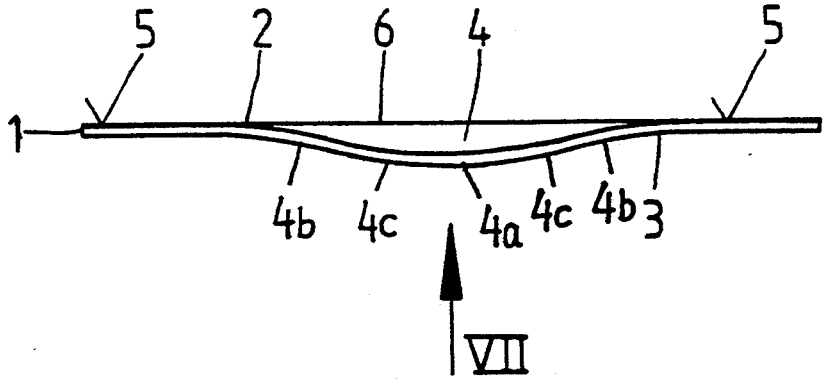

APPARATUS AND METHOD FOR FORMING OF A WIDE SIDE WALL FOR A CHILL MOLD INTENDED FOR A THIN SLAB CASTING INSTALLATION

FIELD OF THE INVENTION

The present invention is directed to an apparatus for and method of forming a wide side wall of a chill mold for a thin slab casting installation.

BACKGROUND OF THE INVENTION

Shaping of the wide side walls of a chill mold has been performed by machining. Such methods however are fraught with high costs because of the required accuracy of the form and the surface quality.

De-AS 25 33 528 discloses a method of fabricating chill mold walls with a convex or concave shape, wherein one mold wall is formed in a die by the detonation force of an explosive. Such a method is expensive, as far as the apparatus involved is concerned and can be used on plates having large dimensions only with difficulty.

The wide side walls of chill mold for continuously cast steels are provided with cooling channels which extend, from the pouring gate, up to the continuous casting outlet end, approximately at equal spacings with respect to the working or active side of the wide side walls.

In chill molds for casting steel strips with a widened pouring region, forming of cooling channels extending at a uniform spacing from the bulged working side of the wide side walls is difficult and expensive. This applies especially to complicated shapes, for instance, according to FIG. 2 of the EP 0 268 910 B1, wherein a uniform spacing between the cooling channels and the working or active side of the wide side walls has not been achieved.

It is therefore an object of the invention to create a method for forming chill mold wide side walls of thin slab or steel strip-casting molds having precise shapes and surfaces economically and affording a high operational safety.

SUMMARY OF THE INVENTION

These and other objects of the invention which shall become hereinafter apparent, are achieved by providing a method of forming a wide side wall for a chill mold intended for a thin slab casting installation, according to which the wall, which has a bulged widening region emanating from the upper edge and terminating towards the sides and bottom, is formed of copper with a thickness of 5-50 mm and is deformed under tension or combination of tension and compression conditions. Open-ended or continuous molds are being used, whose wide side walls form a widened or enlarged region, at least across a portion of their width and height, especially for casting thin slabs and steel strips.

The apparatus according to the invention comprises a bottom plate die having opposite support surfaces for supporting the wide side wall, at least one hold-down pad for holding the wall against the support surfaces and a displaceable upper die which has a face shaped to match a desired bulge of the widened region and cooperating with at least one respective contoured surface of the bottom die to form the wide side wall.

The widened region of a chill mold wide side wall can be shaped in any required form and size by the method of the invention very economically and with a saving of material and energy.

The uniform spacing of the cooling channels from the working side of the wide side wall is maintained in the shaping process according to the invention. The forming under tension or under a combination of tension and compression conditions of the wide side walls does not result in impairing a cross-sectional construction of the cooling channels. Thus the expensive forming of the cooling channels in the wide side walls can be eliminated. The cooling channels may be formed in a simpler and more economic way by milling or boring of the undeformed wide side wall.

It is important for the wide side wall to be held in a straight plane externally of the widened region surface, that a portion of the widened region surface is subjected to pressure form one side and that, on the other side, a portion of the widened region surface is backed up to match the desired bulging.

In addition, the invention proposes, that for forming, under tension or under a combination of tension and compression conditions, of the widened region of a wide side wall formed by a central bulge and two opposite side bulges, pressure be applied at least up to the location line of the turning points of the bulge and that a backup of the other side matching the desired bulge extend into the region of the pressure application.

An apparatus for forming a chill mold wide side wall, according to the described method, is expediently designed in such a way, that a hold-down pad is provided in the region of the contact face, and a power operated die with a shape matching the desired bulge of the widened region be allocated to the contoured faces of the lower die, provided with side support faces and at least one contoured face.

BRIEF DESCRIPTION OF THE DRAWINGS

The invention will be better understood from the following Detailed Description of the Preferred Embodiment, when read in connection with the appended Drawings, of which:

FIG. 1 is a perspective view of a wide side wall of a chill mold;

FIG. 2 is a side view on the wide side wall of a chill mold;

FIG. 7 is a partial elevational view of a wide side wall provided with cooling channels.

DETAILED DESCRIPTION OF THE PREFERRED EMBODIMENT

Figure 3:
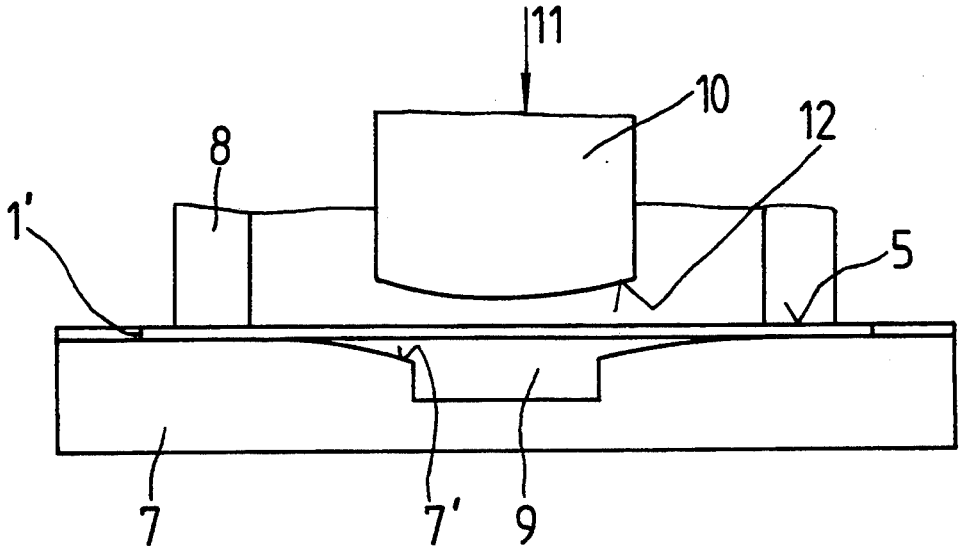
FIG. 3 is an elevational view of an apparatus for forming, under tension or under a combination of tension and compression conditions of a chill mold wide side wall.

Referring now to the drawings, wherein like numerals designate like elements throughout the several views, FIG. 1 shows a wide side wall 1 for a chill mold, comprising a 5-50 mm thick copper plate 1', which has a working side 2 and a cooling water side 3. The wide side wall 1 is provided with a bulged widened region 4 which proceeds from the upper edge and which terminates towards the sides and bottom surfaces 5, 6 (FIGS. 1 and 2). As shown in FIG. 2, the bulged widened region is formed of a central bulge 4*a* and opposite side bulges 4*b*, which are connected with the central bulge 4*a* at respective turning points 4*c*. The wide side wall 1 is provided with cooling channels 13, as shown in FIG. 7.

The shape of the chill mold wide side wall 1, described above and shown in FIGS. 1 and 2, is formed, according to the invention, under tension or under a combination of tension and compression conditions.

As seen from FIG. 3 to 6, this 5–50 mm thick copper plate 1' is held in a straight plane, on a bottom die plate 7, by one or several hold-down pads 8, pressing upon the side and lower plate faces 5, 6. The bottom die plate 7 is provided with a contoured surface 7' for producing the widened region 4, wherein a central partial region remains unsupported because of a recess 9.

An upper die 10 is guided above the bottom die plate 7. The upper die 10 is connected to a power unit symbolized by an arrow 11. The end face 12 of the die 10 is smaller than the surface of the widened region 4 and is matched to the intended bulge of the widened region 4.

The die 10 is narrower than the width of the widened region 4 and in the other direction is wider than the depth of the widened region 4. The width of the die 10 is so dimensioned that the pressure is applied at least up to the location lines of the turning points 4*c*.

Figure 4:
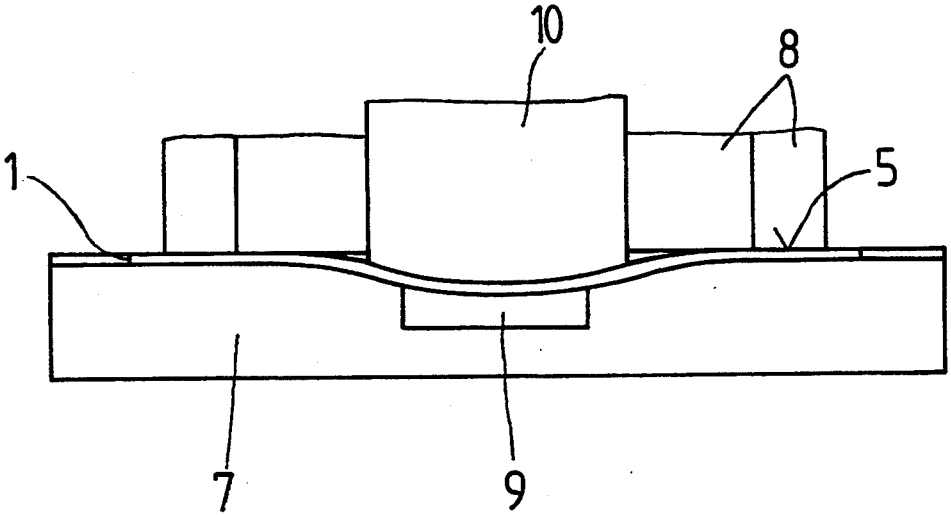
FIG. 4 is a view similar to that of FIG. 3 showing the apparatus of FIG. 3 in a working position.
Figure 6:
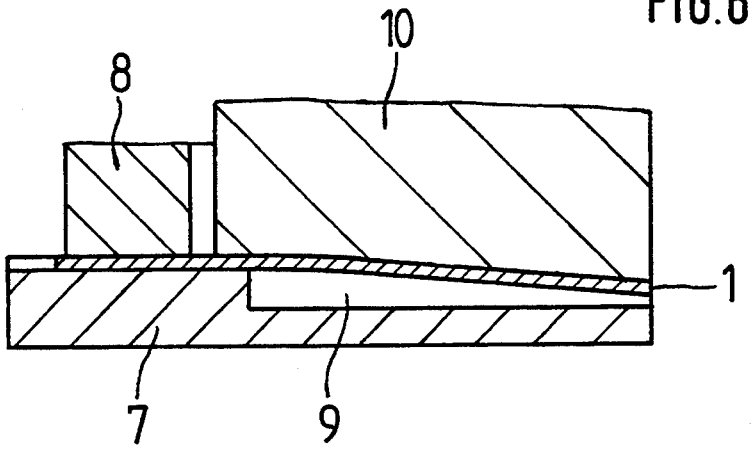
FIG. 6 is a cross-sectional view along the line VI—VI of FIG. 5.
Figure 5:
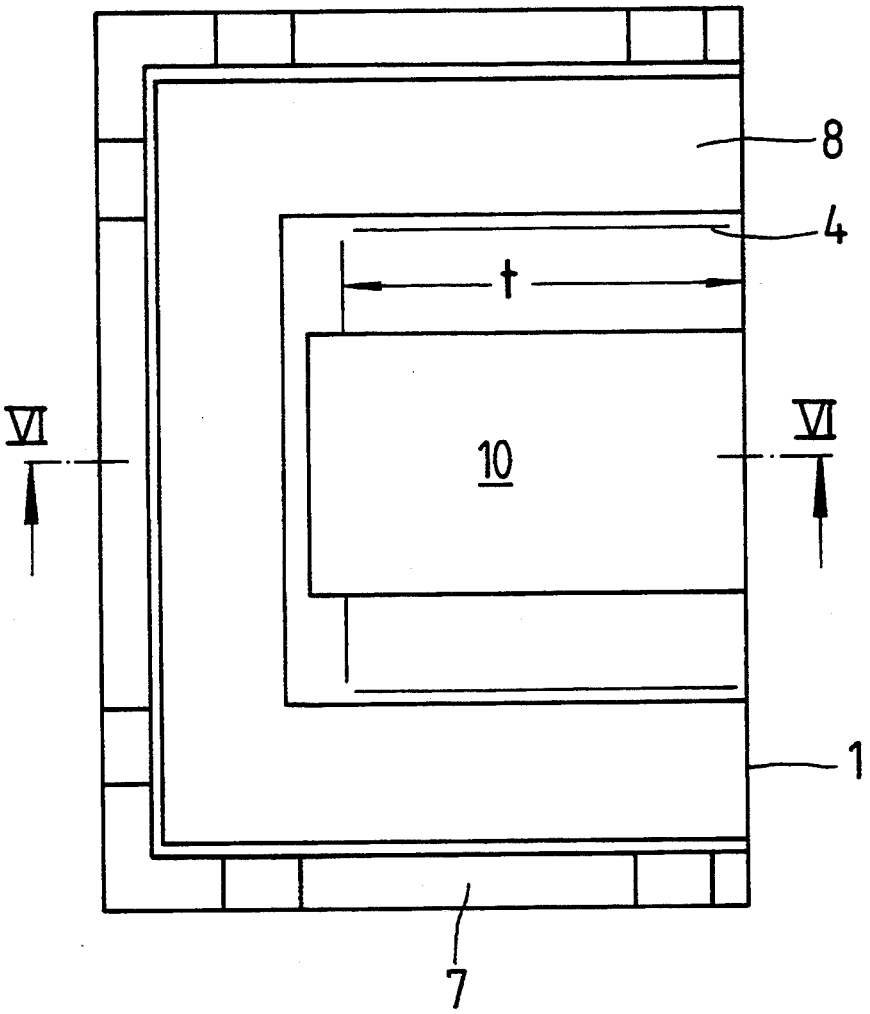
FIG. 5 is a plan view of the apparatus shown in FIGS. 3 and 4.

The die 10 is moved from the position shown in FIG. 3 into the end position shown in FIG. 4 for forming, under tension or under a combination of compression and tension conditions, of the copper plate 1.

While the preferred embodiment of the invention has been depicted in detail, it is to be expressly understood that modification and adaptations may be made thereto without departing from the spirit and scope of the invention as delineated in the following claims:

What is claimed is:

1. An apparatus for forming a wide side wall for a chill mold for a thin slab casting installation, the wall having a bulged widened region proceeding from an upper edge and terminating towards the side and towards the bottom, said bulged widened region being formed of a central bulge and two opposite side bulges connected to the central bulge at respective turning points, said wide side wall further having opposite planar portions provided at opposite ends of bulged widened region, and a thickness of 5–50 mm, said apparatus comprising:

a bottom plate having a recessed region having a width substantially corresponding to a width of the bulged widened region of the wide side wall, opposite support surfaces at opposite side ends of the recessed region, and a contoured face defining the recessed region and profiled in such a manner that the central bulge of the bulged widened region remains substantially unsupported by the contoured face in a finished condition of the wide side wall;

a hold-down pad means for holding the wall in the region of the contact fact thereof against said support surfaces of the bottom die plate; and a power-operated upper die with an end face shaped to match a desired bulge of the widened region and cooperating with said at least one contoured face of said bottom die plate for forming the wide said wall under tension or a combination of compression and tension conditions.

2. The apparatus of claim 1, wherein the upper die is narrower than the width of the widened region of the wall.

3. The apparatus of claim 1, wherein the upper die is wider than the depth of the widened region of the wall.

4. A method of forming a wide side wall of a chill mold for a thin slab casting installation and having a bulged, widened region proceeding from an upper edge and terminating towards the sides and towards the bottom and formed of a central bulge and two opposite side bulges connected to the central bulge at respective turning points, said method comprising the steps of:

providing wide side wall formed substantially of copper and having a thickness of about 5–50 mm;

machining a plurality of cooling channels in the wide side wall; and thereafter, forming the widened region of the wide side wall under tension or a combination of tension and compression conditions, said forming step including holding the wide side wall in a straight plane externally of the widened region surface and applying pressure from one side to a portion of the widened region surface which is backed up on the other side, at least up to location lines of the turning points.

* * * * *